US008047590B1

(12) United States Patent
Hamme

(10) Patent No.: US 8,047,590 B1
(45) Date of Patent: Nov. 1, 2011

(54) UNDERWATER GALVANIC LOAD RELEASE DEVICE

(75) Inventor: Lonnie Hamme, Jamul, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 295 days.

(21) Appl. No.: 12/485,989

(22) Filed: Jun. 17, 2009

(51) Int. Cl.
*B66C 1/00* (2006.01)

(52) U.S. Cl. ..... 294/66.1; 294/82.33

(58) Field of Classification Search ..... 294/66.1, 294/82.24, 82.31, 82.33; 114/312, 330
See application file for complete search history.

(56) References Cited

U.S. PATENT DOCUMENTS 3,316,531 A * 4/1967 Baker ..... 367/118
3,504,407 A * 4/1970 Dawson ..... 24/601.5
3,628,821 A * 12/1971 Reece ..... 294/82.28
3,724,120 A * 4/1973 Richard ..... 43/100
3,729,755 A * 5/1973 Cochrane ..... 441/1
4,148,514 A * 4/1979 McCullough ..... 294/82.34
4,830,174 A * 5/1989 Davidsson ..... 198/465.4
5,513,886 A * 5/1996 Cyr ..... 294/66.1
6,453,602 B1 * 9/2002 Russell et al. ..... 43/100

FOREIGN PATENT DOCUMENTS

GB 2235659 A * 3/1991

* cited by examiner

*Primary Examiner* — Saul Rodriguez
*Assistant Examiner* — Stephen Vu
(74) *Attorney, Agent, or Firm* — Kyle Eppele; Stephen E. Baldwin

(57) ABSTRACT

An underwater load release device for a deployed underwater load comprising a fixed support member having a hinge end and a fixed end, a rotating member connected to the first hinge end, the rotating member initially held in a closed position by a rotatable bail to hold the underwater load, the bail initially held in the closed position by a galvanic timed release link, the galvanic link applying a predetermined bail tension to the bail during load deployment, a spring mechanism for applying a predetermined back tension to the bail during the load deployment, the galvanic release link corroding over a predetermined timed release when immersed underwater whereby the back tension overrides the bail tension of the galvanic link so that the galvanic link releases, the bail rotates into an open bail position and the rotating member then rotates into an open load position, thereby releasing the load.

4 Claims, 9 Drawing Sheets

UNDERWATER GALVANIC LOAD RELEASE DEVICE

FEDERALLY-SPONSORED RESEARCH AND DEVELOPMENT

This invention (Navy Case No 99653) is assigned to the United States Government and is available for licensing for commercial purposes. Licensing and technical inquiries may be directed to the Office of Research and Technical Applications, Space and Naval Warfare Systems Center, Pacific, Code 72120, San Diego, Calif., 92152; voice (619) 553-2778; email T2@spawar.navy.mil.

BACKGROUND OF THE INVENTION

In the deployment of Deployable Autonomous Distributed System (DADS) arrays, strumming of the arrays can occur due to excess strain that was applied during deployment, not allowing the arrays to relax during that deployment. It would be desirable to provide a way to relieve or alleviate that strain.

SUMMARY

An underwater load release device is provided when deploying an underwater load, such as with a deployable autonomous distributed system (DADS) array. The release device includes a fixed support member having a first hinge end and a second fixed end. A rotating member is connected to the first hinge end where the rotating member is initially held in a closed position by a rotatable bail along a mid-portion of the fixed support member to hold the underwater load. The load is released when the bail is rotated into an open bail position. The bail is initially held in the closed position by a galvanic timed release link where the galvanic link applies a predetermined bail tension to the bail from near the first hinge end during load deployment. An adjustable extension spring applies a predetermined back tension to the bail from the second fixed end of the support member during the load deployment, where the bail tension is equal to or greater than the back tension. The galvanic release link corrodes over a predetermined timed release when immersed underwater so that the back tension overrides the bail tension of the galvanic link, and the bail rotates into the open bail position and the rotating member then rotates into an open load position, thereby releasing the load.

BRIEF DESCRIPTION OF THE DRAWINGS

Throughout the several views, like elements are referenced using like references.

DETAILED DESCRIPTION OF THE EMBODIMENTS

The underwater galvanic load device 10, in one embodiment, is intended for use when deploying an underwater load, such as with a deployable autonomous distributed system (DADS) array. The device 10 relieves the strain of a DADS array after deployment to prevent or minimize strumming of a taut array.

Figure 1:
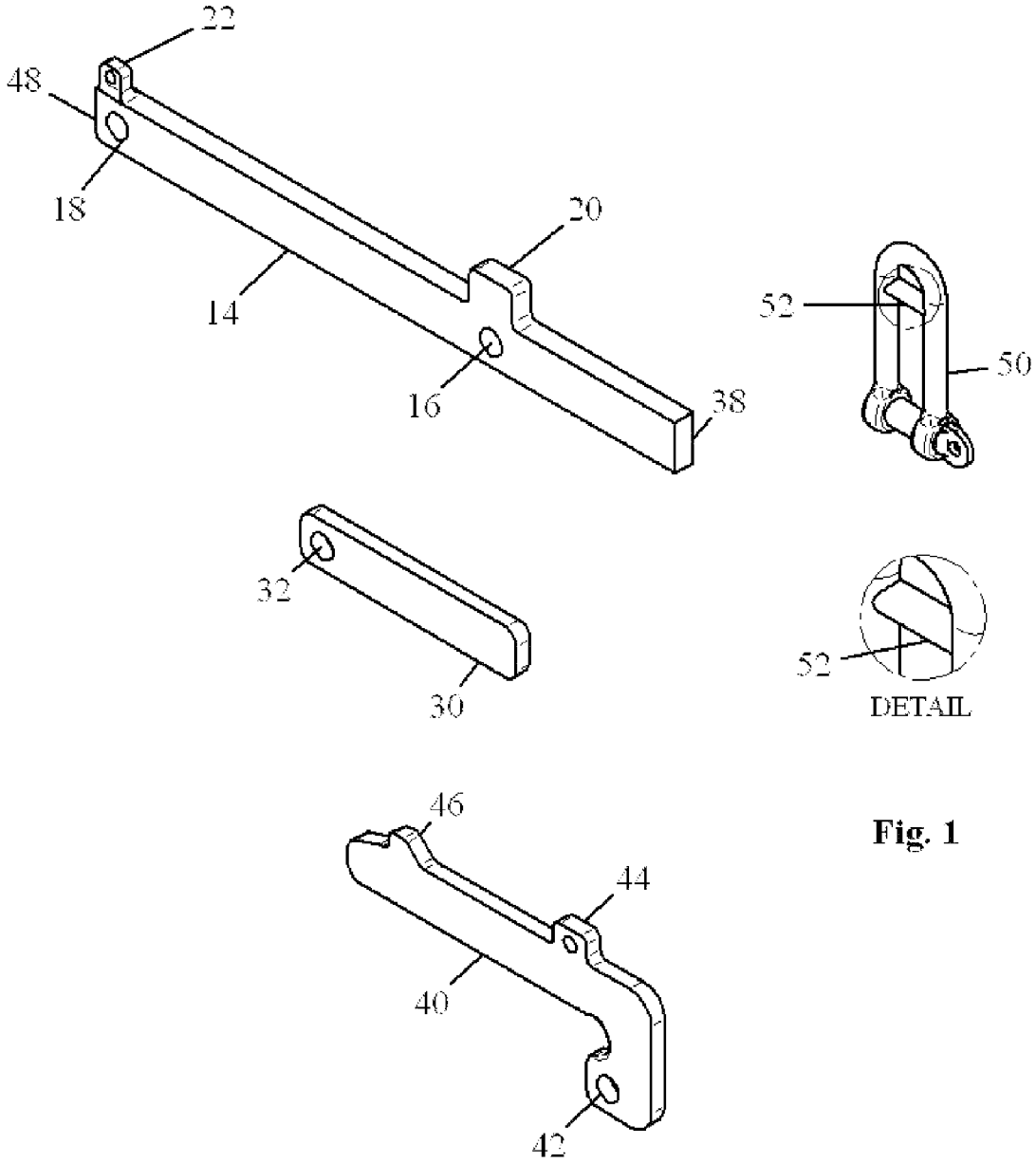
FIG. 1 shows perspective views of several of the components of a underwater galvanic load device.

FIG. 1 shows perspective views of several of the components (not to scale) of the underwater galvanic load device 10. FIG. 1 shows an elongated fixed middle support member 14, having a first end 38 and a second end 48. Member 14 has eyelets or eyeholes 16, 18 formed therein, along with a raised stop 20 and attachment point eyelet 22. Also shown in FIG. 1 is a fixed support member 30 having eyelet 32 formed therein. There are two members 30 which are welded to the sides of member 14, near the fixed end 38, as will be shown in FIG. 2.

FIG. 1 also shows a rotating member 40, which is in the form of a J-shape member, having a lower eyelet 42, a galvanic link attachment eyelet point 44, and a bail stop 46. FIG. 1 also shows a rotatable bail 50 (which typically could be a conventional shackle) which has a bail stop portion or bar 52 welded between the top portions of bail 50. The components shown in FIG. 1 could typically be made of stainless steel.

Figure 2:
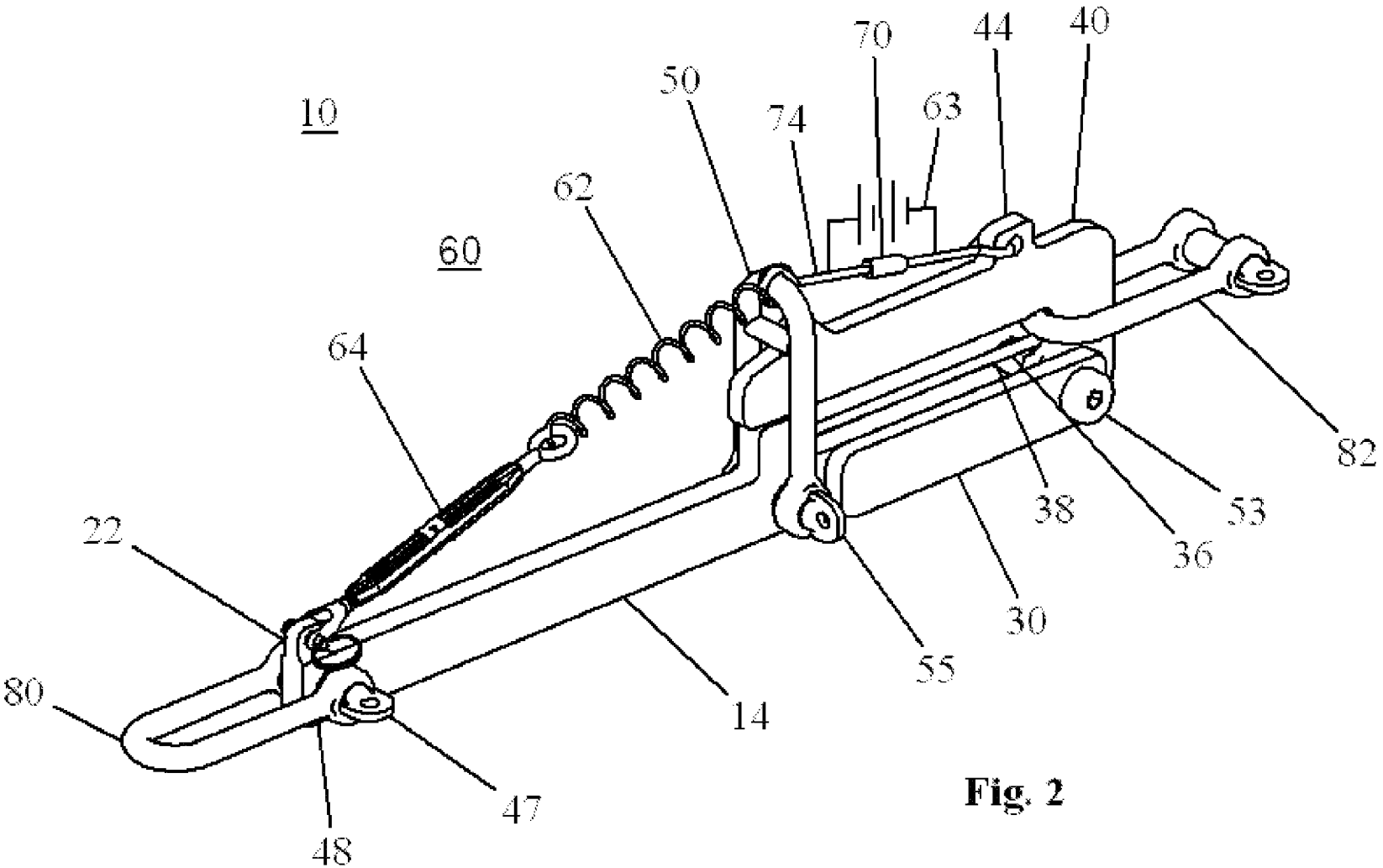
FIG. 2 shows a perspective view of an underwater galvanic load device in an assembled, closed position.

FIG. 2 shows a perspective view of the load release device 10 in an assembled, closed position, and including the components of FIG. 1. In FIG. 2, the device 10 includes the first fixed support member 14 with the two members 30 welded to each side of the support member 30 at or near the first hinge end 38. The welded members 30 form a space 36 into which the eyelet portion 42 of rotating member 44 can be inserted. A hinge pin 53 connects rotating member 42 with the first hinge end 38. Rotating member 42 can be rotated into a closed position to stop 20 in FIG. 2, which then forms a hook-portion for holding a load attached to load shackle 82. Fixed end shackle 80 is connected to the second fixed end 48 of member 14 via hinge pin 47. A catenary line (not shown) can be connected between shackles 80, 82 to assist in the relief of the strumming effect described above, and as shown in FIGS. 6 and 7.

In FIG. 2, bail 50 is connected to support member 14 via hinge pin 55 through eyehole 16 of FIG. 1. When rotated into a closed position, the bail stop bar 52 engages bail stop 46 of rotating member 42 to hold the rotating member 42 in a closed position.

A galvanic time release link 70 is shown in FIG. 2 which can be connected between eyelet point 44 and the stop bar 52 of bail 50. Alternatively, the galvanic link 70 could be connected to the top portion of bail 50. Link 70 can be connected between bail 50 and eyelet 44 via conventional means, such as line 74 or a cable tie, or could be custom ordered.

Suitable galvanic links are readily available, such as from International Fishing Devices, Inc., or Neptune Marine Products, Inc. A suitable link 70 is typically made by inserting plated wire eyes (cathodes) into precisely machined cylinders of a highly active metal alloy (anode).

The release link 70 can readily be obtained from a suitable source such as above, and can operate with predetermined timed releases when immersed underwater, ranging from hours to days, depending upon the application. When the galvanic link 70 is immersed in an electrolyte such as seawater, the cathodes, being plated with a more passive or noble metal, cause the cylinder of more anodic or active material to electrochemically degrade, and release, over a predetermined time period.

In FIG. 2, an adjustable extension spring mechanism 60 is connected between eyelet 22 of member 14 and bail 50. The spring mechanism 60 includes an extension spring 62 and a tension turnbuckle 64 to provide a predetermined back tension to the bail 50. The galvanic link 70 applies a predetermined bail tension to the bail 50. Preferably, the bail tension of galvanic link 70 is equal to or greater than the back tension of spring mechanism 60.

In operation, the galvanic link 70 corrodes over a predetermined timed release when immersed underwater. The back tension of the spring mechanism 60 overrides the bail tension of the galvanic link so that the link 70 releases (opens), the bail 50 rotates in an open bail position, and the rotating member 42 rotates into an open load position, thereby releasing the load. In addition, in order to shorten the link 70 opening release time, an optional electrical current source 63 could be provided, as shown in FIG. 2. Current source 63 could act to accelerate the corrosion process time of link 74, as would be apparent.

Figure 3:
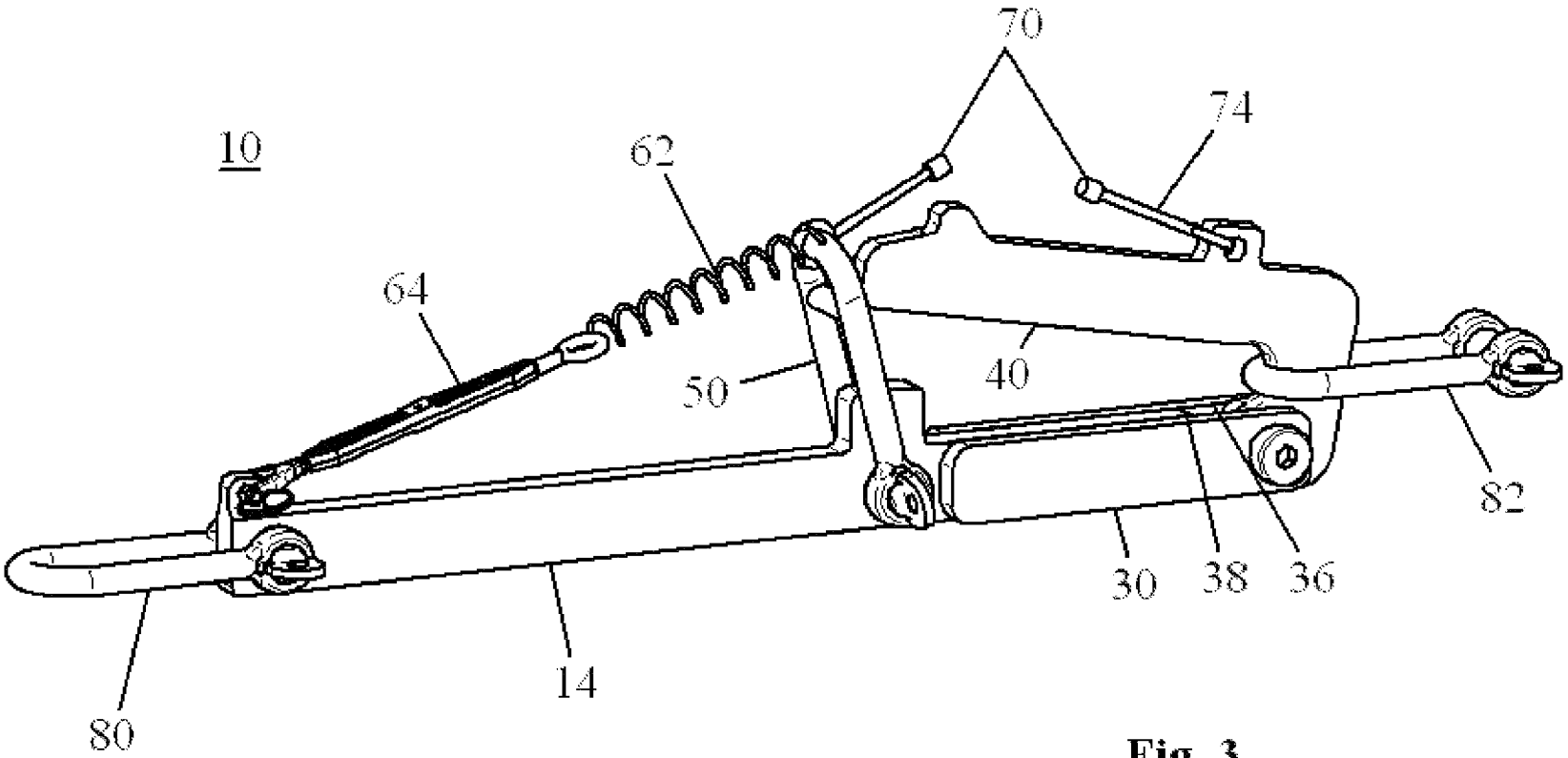
FIG. 3 shows perspective view of the underwater galvanic load device of FIG. 2 in a partially open position

FIG. 3 shows a perspective view of the device 10 in a partially open position. The galvanic link 70 has released (opened) within a predetermined time period after immersion underwater, as shown in FIG. 3. The back tension of the spring mechanism 60 has now overridden the bail tension provided by the galvanic link 70, and the spring mechanism 60 now rotates the bail 50 toward the second fixed end 48. The rotating element 42 now rotates into a partially open position, as shown in FIG. 3.

Figure 4:
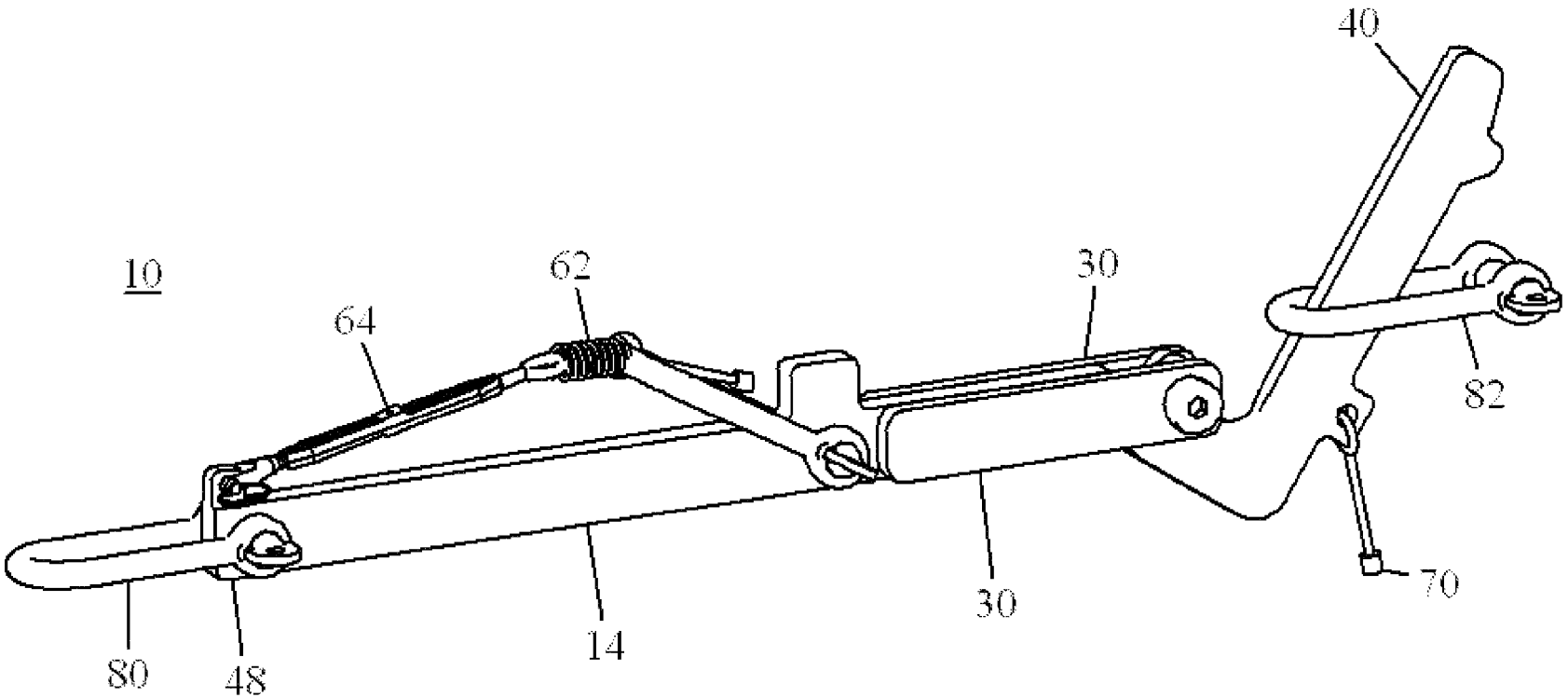
FIG. 4 shows perspective view of the underwater galvanic load device of FIG. 2 in a more open position.

FIG. 4 shows a perspective, more-opened view of the device 10 with the spring 62 in a compressed spring position, with the bail 50 rotated back fully toward the fixed end 48. The rotating member 40 has now rotated upward from the stop 20.

Figure 5:
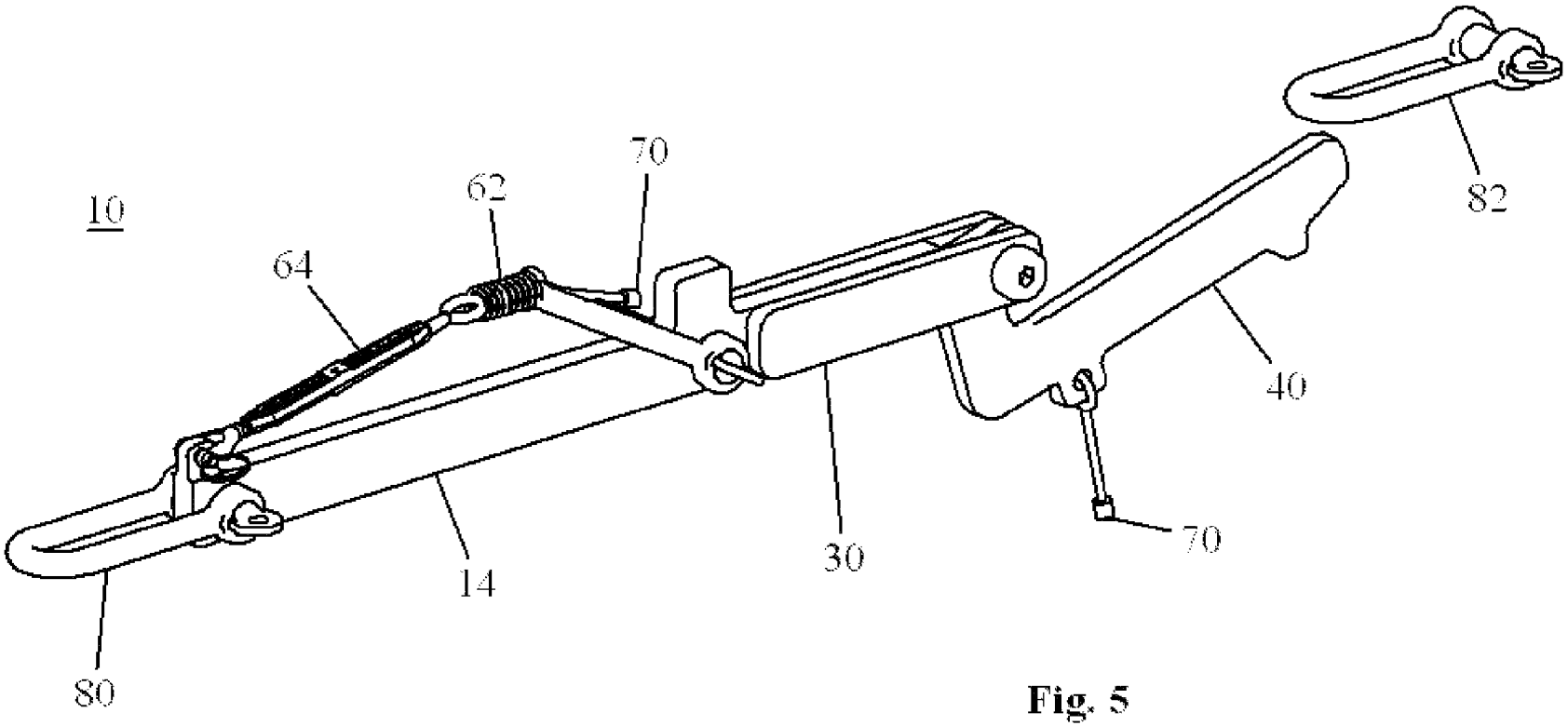
FIG. 5 shows a perspective view of the underwater galvanic load device of FIG. 2 in an open, released position.

FIG. 5 shows a perspective view of the device 10 in the open bail position, and with the open load position of the rotating element 40. Notice that the load shackle 82 has now been released, thereby releasing the load.

Figure 6:
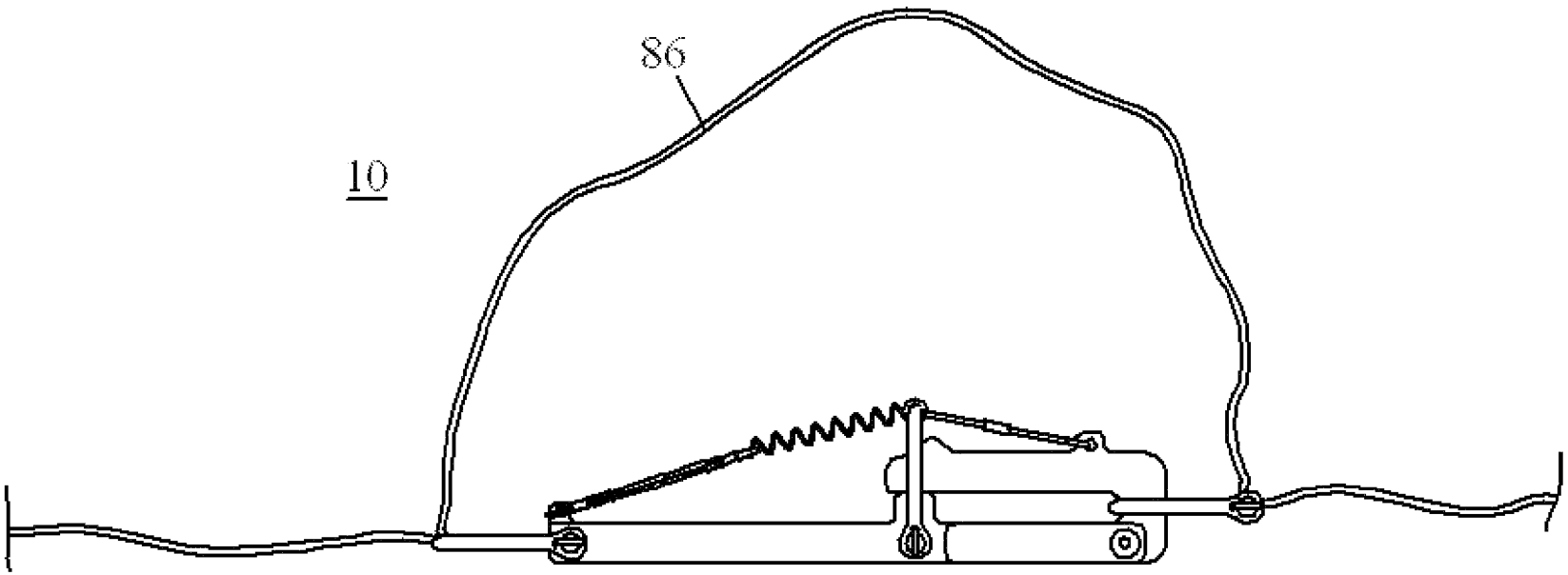
FIGS. 6 and 7 show views of the underwater galvanic load device, before and after release of a load, respectively.
Figure 7:
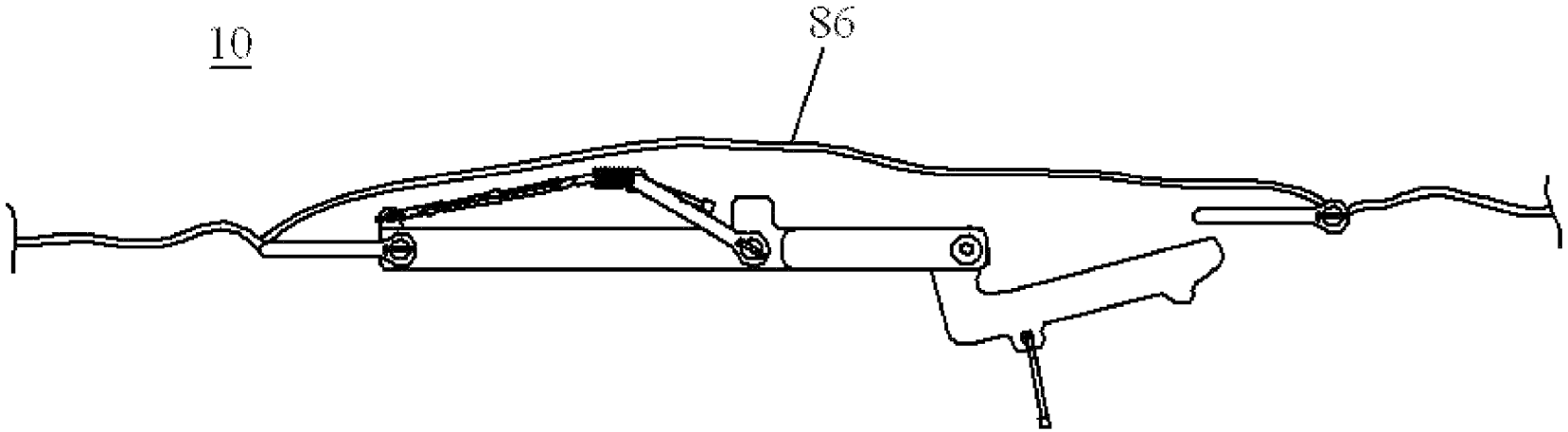

FIG. 6 shows a view of the device 10 when deploying a load with the device 10 in a closed position, with a catenary line 86 as shown, with approximately 2-3 feet of slack, as an example, and FIG. 7 shows the device 10 in an open position, with the catenary line 86 extended, showing the arrangement as could be utilized such as in a DADS array.

When utilized in a DADS array environment, one example of a load weight could be 500 pounds. It was calculated that approximately 60 pounds of back tension was needed, which can be provided by suitable adjustment of the back turnbuckle 64 of FIG. 2. The bail tension provided by the galvanic release link 74 was initially greater than or equal to the back tension in order to maintain the device 10 in a closed position, as shown in FIG. 2.

The release device 10 holds the hook-portion closed, thereby holding the deployed load, and a small galvanic link 70 is all that is required to keep the bail 50 in a closed position (the hood-portion holds the load, not the link 70). The back tension of the spring mechanism 60 overrides the bail tension over a predetermined time (typically 4-5 hours), thereby opening the bail 50 and releasing the load. The predetermined time period can be varied, depending upon the type of galvanic timed release device utilized. It does not matter what load is present, as the bail 50 will open.

Figure 8:
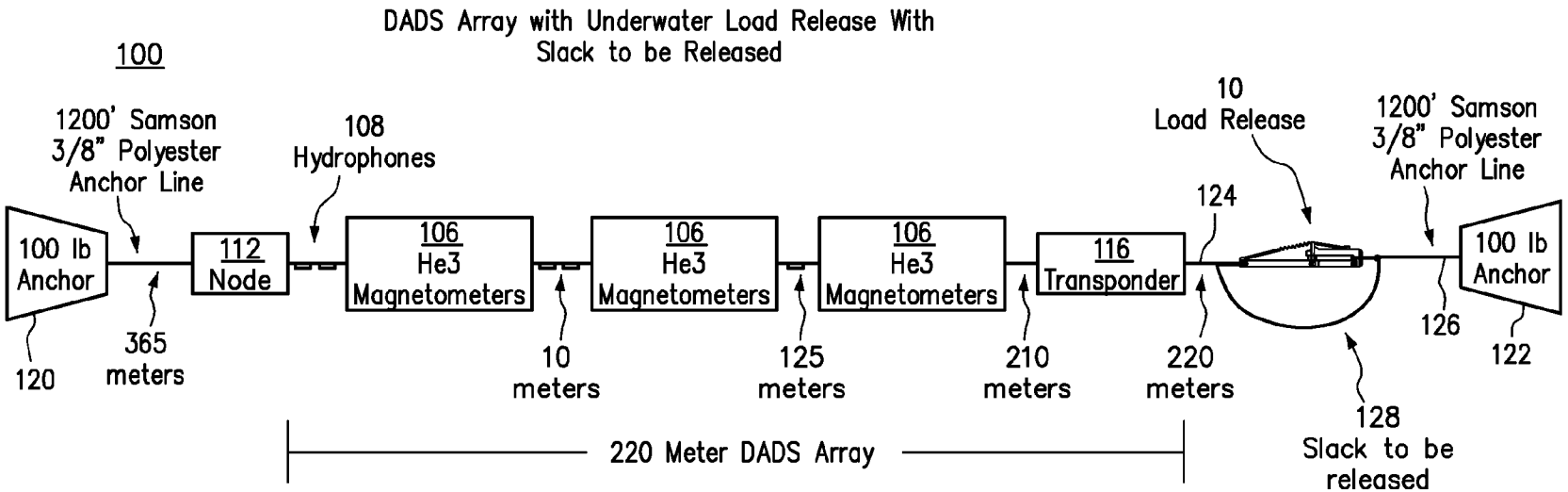
FIGS. 8 and 9 show views of a DADS array with the underwater galvanic load device of FIGS. 1-7.

FIG. 8 is a line drawing of the underwater galvanic load release device 10 with a DADS array 100, showing the basic components and typical lay down arrangement on the sea floor after deployment.

The DADS array 100 shown in FIG. 8 is in a lay down arrangement of about 220 meters in width, and could includes HE3 magnetometers 106, hydrophones 108, a node 112 and a transponder 116. The DADS array 100 is connected between anchor 120 and anchor 122, with load release device 10 connected between anchor 122 and transponder 116 via lines 124, 126. An amount of slack line 128 to be released by device 10 could be about, for example, 2-5 feet or more, as needed. The array strength member is Samson Tech 12 with a specific gravity of 1.39. The ⅜" polyester line 126 is Samson Stable braid with a specific gravity of 1.38.

After separation, the released galvanic link allows the tension produced by deployment to be relieved, which allows the array 100 to relax and prevent strumming by a taut array cable. FIG. 8 shows the load release device 10 in the closed position holding the slack to be released prior the galvanic link corroding and allowing the rotating member to move into the open position.

Figure 9:
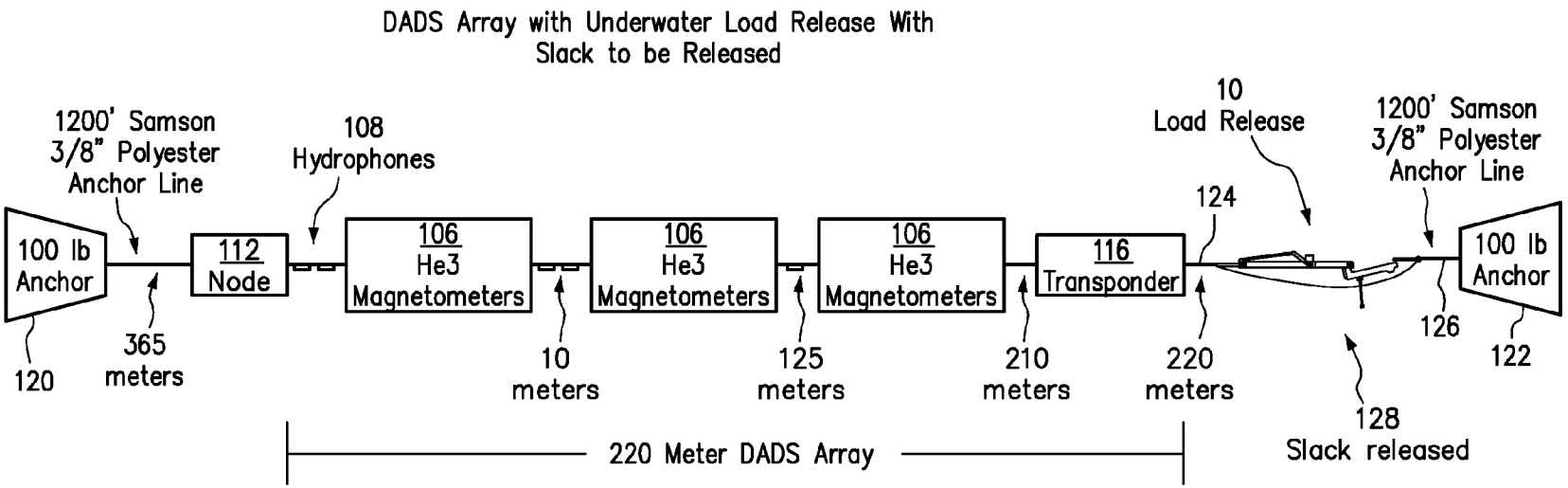

FIG. 9 shows a line drawing of a DADS array 100 showing the basic components and typical lay down arrangement on the sea floor after deployment. The drawing shows the load release device 10 after galvanic link corrosion and rotating member in the open position with the slack released and tension relieved from the array 100.

From the above description of the Underwater Galvanic Load Release Device, it is apparent that various techniques may be used for implementing the concepts of system 10 without departing from its scope. The release device could be used in many different applications i.e. vertical arrays, underwater vehicles, and subsurface buoys. Also, applying a small amount of electric current to the galvanic link can speed up the corrosive process. A link other than a galvanic timed release could also be utilized, such as an acoustic or other type release device. The described embodiments are to be considered in all respects as illustrative and not restrictive. It should also be understood that system 10 is not limited to the particular embodiments described herein, but is capable of many embodiments without departing from the scope of the claims.

What is claimed is:

1. An underwater load release device for a deployable underwater load comprising:

a fixed support member having a first hinge end and a second fixed end, a rotating member connected to the first hinge end, the rotating member initially held in a closed position by a rotatable bail along a mid-portion of the fixed support member to hold the underwater load, the load being released when the bail is rotated into an open bail position, the bail initially held in the closed position by a galvanic timed release link, the galvanic link applying a predetermined bail tension to the bail from near the first hinge end during load deployment, an adjustable extension spring for applying a predetermined back tension to the bail from the second fixed end of the support member during the load deployment, where the bail tension is equal to or greater than the back tension, the galvanic release link corroding over a predetermined timed release when immersed underwater whereby the back tension overrides the bail tension of the galvanic link so that the bail rotates into the open bail position and the rotating member then rotates into an open load position, thereby releasing the load.

2. An underwater load release device for a deployable underwater load comprising:

a fixed support member having a first hinge end and a second fixed end, a rotating member connected to the first hinge end, the rotating member initially held in a closed position by a rotatable bail to hold the underwater load, the bail initially held in the closed position by a galvanic timed release link, the galvanic link applying a predetermined bail tension to the bail during load deployment, a spring mechanism for applying a predetermined back tension to the bail during the load deployment, where the bail tension is equal to or greater than the back tension, the galvanic release link corroding over a predetermined timed release when immersed underwater whereby the back tension overrides the bail tension of the galvanic link so that the galvanic link releases, the bail rotates into an open bail position and the rotating member then rotates into an open load position, thereby releasing the load, the rotatable bail holding the rotating member along a mid-portion of the fixed support member to hold the underwater load, the galvanic link applying the predetermined bail tension to the bail from a top portion of the rotating member near the first hinge end, and where the spring mechanism comprises an adjustable extension spring for applying the predetermined back tension from the second fixed end of the support member during the load deployment.

3. A device as in claim 2, including a current source for applying an electrical current to the galvanic link to shorten the time release.

4. In a deployable autonomous distributed system (DADS) array load, an underwater load release device releasing for releasing the deployed array load comprising:

a fixed support member having a first hinge end and a second fixed end, a rotating member connected to the first hinge end, the rotating member initially held in a closed position by a rotatable bail along a mid-portion of the fixed support member to hold the underwater array, the load being released when the bail is rotated into an open bail position, the bail initially held in the closed position by a galvanic timed release link, the galvanic link applying a predetermined bail tension to the bail from near the first hinge end during load deployment, an adjustable extension spring for applying a predetermined back tension to the bail from the second fixed end of the support member during the load deployment, where the bail tension is equal to or greater than the back tension, the galvanic release link corroding over a predetermined timed release when immersed underwater whereby the back tension overrides the bail tension of the galvanic link so that the bail rotates into the open bail position and the rotating member then rotates into an open load position, thereby releasing the load, and a current source for applying an electrical current to the galvanic link to shorten the time release.

* * * * *